United States Patent [19]

Marchand et al.

[11] Patent Number: 5,033,154

[45] Date of Patent: Jul. 23, 1991

[54] ADJUSTABLE HEAD TOOTHBRUSH

[76] Inventors: Paul Marchand; Willard Marchard, both of 1171-71st St., Miami Beach, Fla. 33141; Noel W. Abramson, 830 West 32nd St., Hialeah, Fla. 33012; Stuart Rapee, 3620 Yacht Club Dr., TH 506, Miami, Fla. 33180

[21] Appl. No.: 474,580

[22] Filed: Feb. 2, 1990

[51] Int. Cl.[5] ..... A46B 7/02

[52] U.S. Cl. ..... 15/167.1; 15/144 R; 15/145; 15/172; 15/176.6; 403/123; 403/160

[58] Field of Search ..... 15/144 R, 144 A, 145, 15/167.1, 172, 176.1, 176.6; 403/123, 160

[56] References Cited

U.S. PATENT DOCUMENTS

| | | | |
|---|---|---|---|
| 1,131,863 | 3/1915 | Phillips | 15/176.6 |
| 2,921,326 | 1/1960 | Lautmann | 15/145 |
| 4,592,109 | 6/1986 | Borea et al. | 15/172 |
| 4,598,437 | 7/1986 | Ernest et al. | 15/176.1 |
| 4,654,922 | 4/1987 | Chen | 15/144 A |
| 4,796,325 | 1/1989 | Bortmann | 15/144 A |
| 4,811,445 | 3/1989 | Lagieski et al. | 15/176.6 |

FOREIGN PATENT DOCUMENTS

| | | | |
|---|---|---|---|
| 83787 | 7/1983 | European Pat. Off. | 15/172 |
| 274618 | 7/1988 | European Pat. Off. | 15/167.1 |
| 216735 | 6/1924 | United Kingdom | 15/144 A |
| 2081570 | 2/1982 | United Kingdom | 15/176.6 |

*Primary Examiner*—Philip R. Coe
*Assistant Examiner*—Mark Spisich
*Attorney, Agent, or Firm*—Malloy, Downey & Malloy

[57] ABSTRACT

A toothbrush structure having a head which may be removably attached to a handle at any one of a plurality of operative positions wherein such operative positions are defined by a first, substantially straightline orientation between the handle and the head and a remainder of said operative positions are defined by various angular orientations of said head and handle to accomplish the best angle of approach of the bristles mounted on the head to the teeth being cleaned by the brush in the user's mouth.

6 Claims, 3 Drawing Sheets

ADJUSTABLE HEAD TOOTHBRUSH

BACKGROUND OF THE INVENTION

1. Field of the Invention

This invention relates to a toothbrush which may have one of a variety of heads, a massage structure or the like, with bristles mounted thereon secured in either a straightline and/or adjustable angular orientation to the handle.

2. Description of the Prior Art

Toothbrushes, of course, have been used in modern day society for many years. Accordingly, the prior art is replete with various design configurations, structures, materials, etc. incorporated in the basic toothbrush. These design changes and alterations have been made for the purpose of better facilitating the cleaning of the teeth. One problem generally associated with the manufacture of an efficient toothbrush is achieving the proper angle of the head and, of course, the bristles mounted thereon relative to the teeth being cleaned. In order to solve this problem, a relatively recent development has been a fixed one piece handle and head wherein the head portion was arranged at a predetermined allegedly "most efficient" angle for cleaning.

It should be obvious to even the most casual observer that the best or most appropriate angle of the handle to the head depends upon which of the plurality of teeth in the user's mouth are being cleaned. As an obvious example, the back teeth are best reached when the head is mounted on the handle at a different angle than if the front teeth were being brushed. In such a situation, it is clear that a fixed angle toothbrush does not always achieve the most efficient angle for bristle contact with the teeth being cleaned.

In order to overcome all of the above se t forth problems, the prior art has developed numerous structural designs incorporating what may be referred to as a "adjustable" head having bristles mounted thereon wherein the head is selectively disposable at various orientations to the handle portion of the toothbrush. The following U.S. Patents disclose structures which are generally representative of this type of adjustable head toothbrush.

Hyman, U.S. Pat. No. 4,488,328, discloses a floating head toothbrush having an elongated handle and a brush head supported at one end which is capable of somewhat limited pivotal movement between opposed arms of a supporting yoke like structure. Hyman does not necessitate the removal and reorientation of the head bu t rather, relies on a certain amount of permissible movement of the head when the bristles thereon engage the teeth to be cleaned.

Stevens, U.S. Pat. No. 4,575,894, discloses a vertical action toothbrush designed for brushing along the major axis of the teeth and incorporating a tongue-in-groove means so that the head can easily be removed and replaced on the same handle and also incorporating a resilient means for automatically promoting a wiping action of the bristles and a reorientation of the head and bristles.

Del Rosario, U.S. Pat. No. 4,333,199, discloses an improved toothbrush which includes an elongated handle and a brush with a base and a mounting in the form of a coil spring connecting the brush base to the distal end of the handle which enables the head to swing, rotate or tilt for an allegedly more efficient orientation of the brush relative to the teeth being cleaned.

Bortman, U.S. Pat. No. 4,796,325, discloses a swivel type, angularly adjustable, double headed toothbrush capable of brushing oppositely disposed surfaces of the same tooth at the same time and further wherein the head is specifically adjustable relative to the supporting handle.

Other patents exist which while not specifically directed to a toothbrush structure do show a head having bristles mounted thereon and selectively positionable at various angular orientations relative to a supporting handle. These structures are represented in Booharin, U.S. Pat. No. 2,395,245 and Johnson, U.S. Pat. No. 3,604,044.

The patent to Borea, U.S. Pat. No. 4,592,109, discloses a toothbrush device having a handle or grip portion which is anatomically formed to fit the hand of the user and wherein a head portion is relatively attachable to the handle in a variety of different positions. The position or orientation of the grip or handle in the hand of the user cooperates with the position of the head attached to the handle to allegedly accomplish the proper angle of attack of the bristles to the teeth being cleaned.

Even in light of the structures as set forth above, there is still a need in this industry for a toothbrush structure which includes a head capable of assuming a plurality of operative positions which are defined by a straightline orientation of the head and handle as well as a plurality of different angular orientations of the head relative to the handle. The user may therefore selectively orient the head as well as the bristles thereon to a "preferred" angular orientation best suited. In addition, such a preferred structure should also include a handle capable of being used with a variety of heads wherein each head may, for example, include a bristle structure of different flexibility, softness, rigidity, design configuration, etc.

SUMMARY OF THE INVENTION

The present invention relates to a toothbrush structure of the type wherein a head having the cleaning bristles attached thereto is mounted on a supporting and gripping handle at a plurality of operative positions defined individually by at least one substantially coaxial or straightline position and a plurality of angularly oriented positions. The orientation may be at a plurality of different angles to best accomplish reaching the various teeth in the mouth of the user.

The structure of the present invention comprises an elongated handle of sufficient dimension and configuration to facilitate gripping by the hand of the user as well as manipulation of the brush during the cleaning process. The structure includes at least one head having bristles extending outwardly from at least one side thereof and further including a somewhat elongated connecting stem terminating at a free end. A free end of the head portion is dimensioned and structured to mate in confronting engagement with a corresponding free end of the handle when the attached head is connected to the handle in any one of its plurality of operative positions.

A mounting means is secured both to the handle as well as being at least partially formed on the head and comprises an elongated mounting rod fixed to the aforementioned free end of the handle and extending outwardly therefrom at an angular orientation which is not parallel to or colinear with the central longitudinal axis of the handle. Similarly, an elongated receiving channel is integrally formed in the handle in an orientation which is not colinear or parallel to the central longitudinal axis of the head. The outer surface of the mounting rod and the inner surface of the receiving channel are respectively configured so as to prevent relative rotation of the head and handle. However, the head can be removed by pulling longitudinally away from the mounting rod and replaced at a different angular orientation to dispose the head and the bristles thereon in one of the aforementioned plurality of operative positions.

It should be readily apparent therefore that a user may have one head which he may attach at any of the aforementioned straightline or angularly oriented, operative positions or alternately, one or more users may utilize the structure by having one handle attachable to any number of heads. In this latter embodiment, each of the bristles on the various heads may have a different configuration, degree of flexibility, strength, size, etc.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DESCRIPTION OF THE PREFERRED EMBODIMENT

Figure 1:
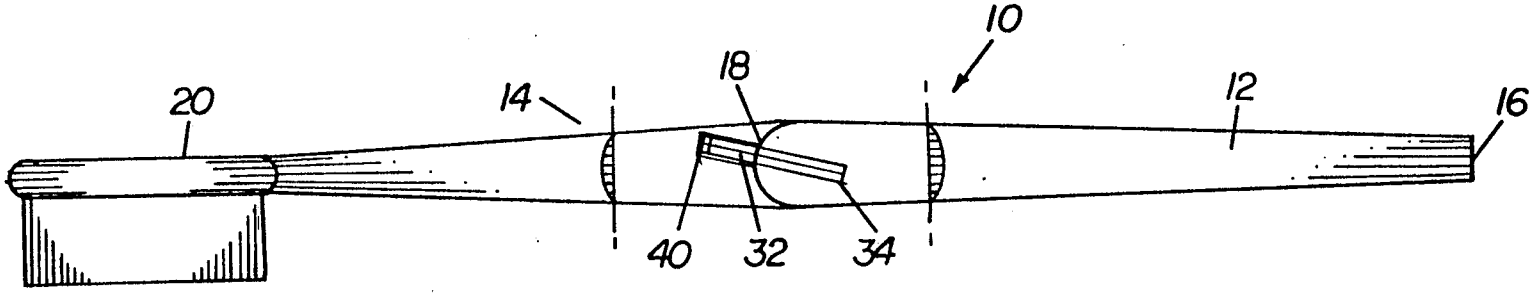
FIG. 1 is a side view of the tooth brush of the subject invention in assembled form.

The toothbrush assembly of the present invention is generally indicated as 10 and comprises a handle 12 and a head portion generally indicated as 14. The handle has an elongated configuration of sufficient length and overall external configuration to facilitate gripping thereof by the hand of the user. The handle 12 terminates at oppositely disposed free distal end 18 and proximal end 16.

The head 14 comprises a bristle attachment area as at 20 to which a plurality of bristles may be mounted so as to extend outwardly therefrom as at 22. It should be emphasized that while the structure of the present invention is demonstrated with the aforementioned bristle structure 20, other elements such as a rubber tip or like massage device could be substituted and still be within the scope of the present invention. The configuration and position of the bristles 22 may vary and still be within the intended scope of the present invention. An elongated stem as at 24 is also an integral part of the head 14 and serves to interconnect the bristle and the bristle mounting portion 22 and 20, respectively, to the handle 12. More specifically, one corresponding free end as at 26 is designed to confrontingly engage the distal end 18 of the handle 12. The free end 26 is formed in somewhat of a receiving socket which corresponds to and receives therein an outward somewhat tapered protuberance defining the distal end 18 as shown.

An important feature of the present invention is the mounting means generally indicated as 30. The mounting means comprises an elongated rigid material substantially high strength mounting rod 32 affixed to and extending outwardly from the distal end 18. In one embodiment, the mounting rod 32 may have a sufficient length to have one inner most end 34 embedded in somewhat of an integral formation into the interior of the handle 12 as shown such that the remainder thereof extends outwardly from the free end at an angular orientation. More specifically, the elongated mounting rod 32 is mounted on or attached to the handle 12 in a location where it is not colinear with or parallel to the central longitudinal axis of the handle 12. To the contrary, it is arranged at a predetermined specific angular orientation as shown.

Figure 2:
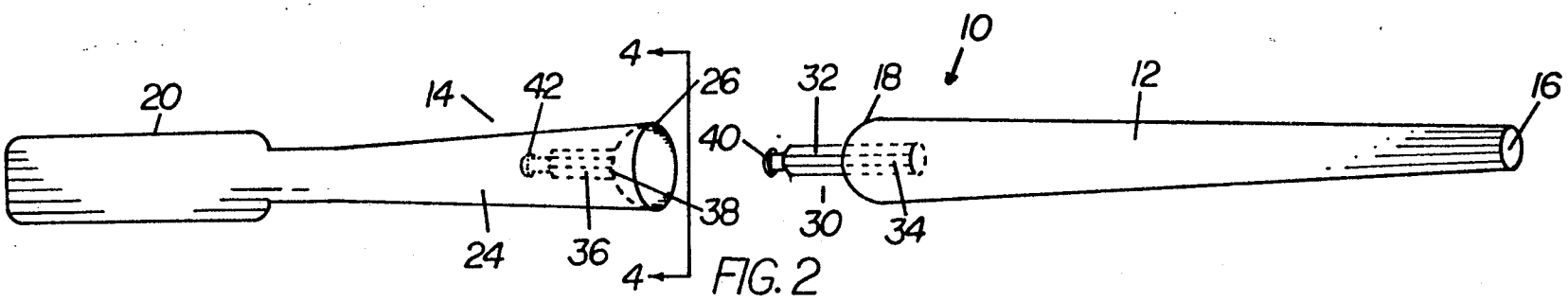
FIG. 2 is a side view in unassembled form.
Figure 4:
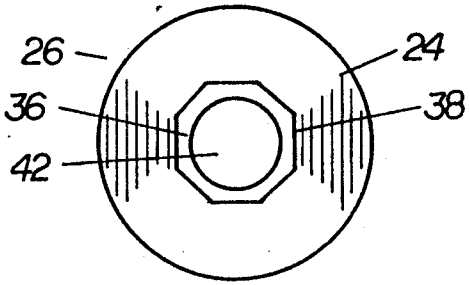
FIG. 4 is a sectional view along line 4—4 of FIG. 2.
Figure 3:
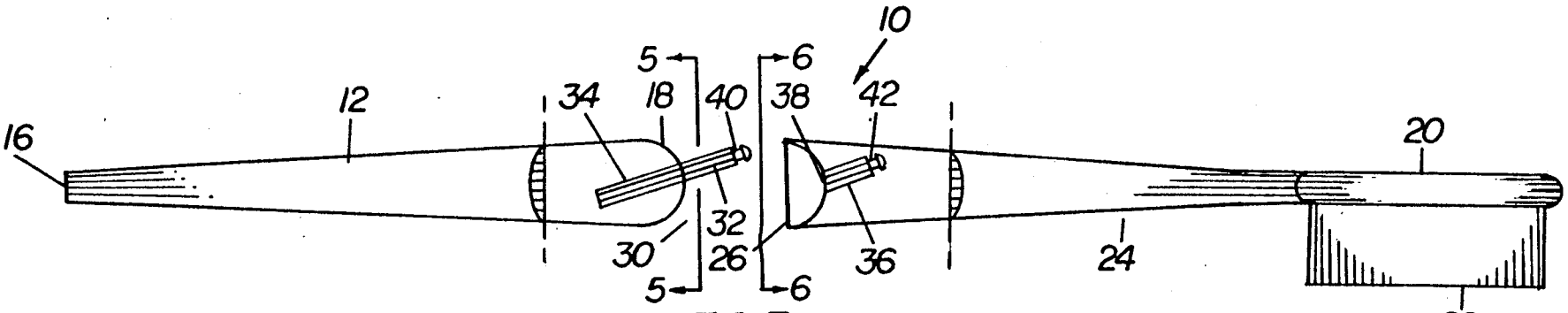
FIG. 3 is a side view of ne embodiment of the present invention also in unassembled position.
Figure 7:
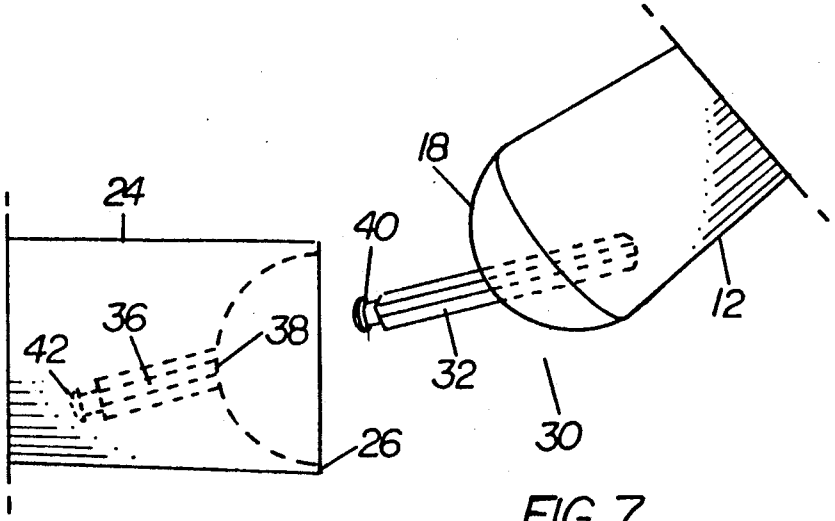
FIG. 7 is a separated view in partial cutaway.
Figure 6:
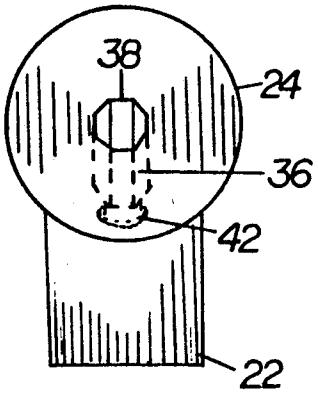
FIG. 6 is a sectional view along line 6—6 of FIG. 3.
Figure 5:
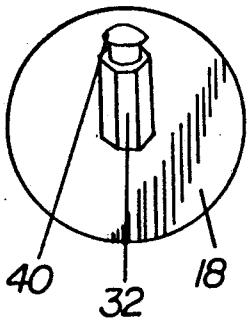
FIG. 5 is a sectional view along line 5—5 of FIG. 3.
Figures 8, 9, 10:
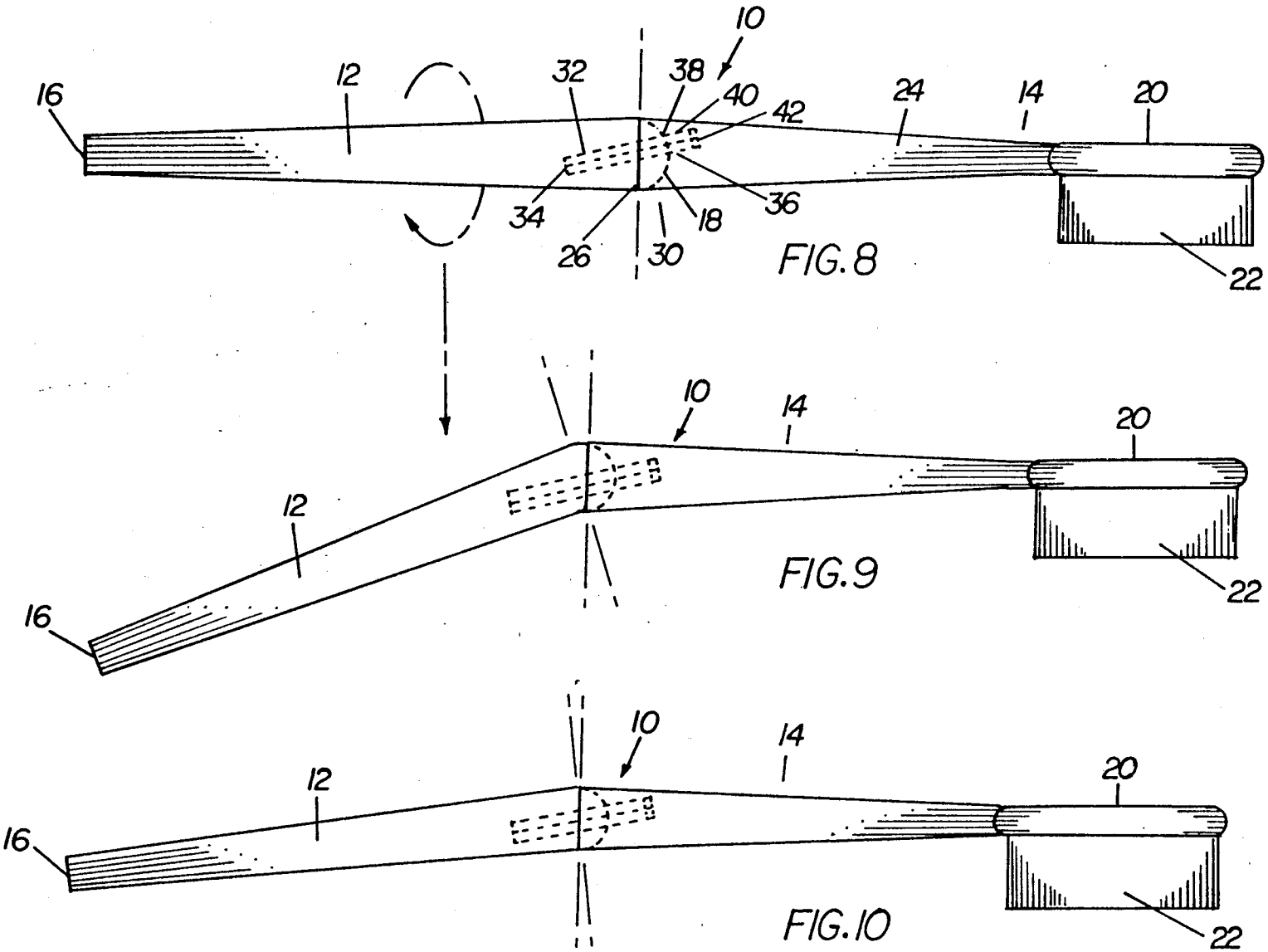
FIGS. 8, 9 and 10 are respectively side views of the toothbrush assembly of the present invention representing different angular orientations of the head relative to the handle.

The mounting means 30 further comprises-an elongated receiving channel 36 formed on the interior of the head 14 and includes an open end as at 38 which is adjacent or contiguous with the free end 26. Both the dimension of the open end 38 and the interior of the channel 36 are such as to allow the mounting rod to be placed therein. Further, at least a portion of the length of both the mounting rod 32 and the channel 36 may be correspondingly configured to prevent relative rotation between the handle 12 and the head 14. This can be accomplished by having a multi-sided configuration formed on at least one exterior portion of a length of the mounting rod 32 and a corresponding multi-sided configuration disposed along at least a portion of the length of the interior of the channel 36. It should be noted, of course, that the elongated channel 36 is also disposed at an angular orientation relative to the central longitudinal axis of the head 14 so as to not be colinear therewith or parallel thereto. The cooperative angular orientations of the rod 32 and the channel 36 therefore allow the mounting of the head in any one of a plurality of operative positions. This is accomplished by separating the head 14 from the handle 12 by removing the mounting rod 32 from the channel 36 and then rotating the head 14 to a desired position relative to the handle 12. The mounting rod 32 may then be reinserted into the channel 36 with the multi-sided configuration on the mounting rod 32 in mating alignment with the corresponding multi-sided configuration within the channel 36. One such operative position may be a straightline substantially linear relative orientation between the head and the handle wherein the mounting rod 32 and channel are in alignment with the length of the attached handle 12 and head 14, as shown in FIGS. 1 and 2. Alternately, the head may be arranged at any of a plurality of different angular orientations relative to the handle so as to give the user thereof a choice of angles to accomplish the best results in cleaning. The number of operative positions which the head 14 may assume relative to the handle 12 may in fact be determined by the number of faces or sides. on the multi-sided configuration along an external surface of the rod 32 and an internal surface of the channel 36 as set forth above.

Further, an attachment means is provided in the form of an enlarged attachment member or head 40 extending radially outward from at least a portion of the remainder of the rod 32. This attachment member is mounted for receiving engagement within a receiving portion or pocket 42 formed on the interior of the channel 36 along a portion of the length thereof. The material from which the portion of the handle 14 and more particularly, the stem 24 substantially surrounding the receiving portion or pocket 42 has sufficient flexibility to allow at least some outward expansion thereof to accommodate for the enlarged head or attachment member 40 as it passes into the receiving pocket 42. Such flexibility will prevent inadvertent dislodgment or displacement of the head 14 from the handle 12 but will allow its removal and replacement at a different operative position, if such is desired, when sufficient pulling force is applied to the head 14 against the handle 12.

In operation, the head is merely pulled from the handle, realigned at a different operative position, either straightline or angular orientation, and then replaced back in its attached position. Because the mounting rod 32 extends from the distal end 18 at an angular orientation to the handle 12, and the channel 36 is also disposed at an angular orientation relative to the longitudinal axis of the head 14, the achieved operative position depends upon the rotated position of the head relative to the handle.

It should also be emphasized that the handle 12 can be used with a great number of different heads 14 each of which may have a different bristle configuration, strength, etc.

Now that the invention has been described, what is claimed is:

1. A toothbrush assembly comprising:

a. a handle having an elongated configuration and being externally shaped and dimensioned to facilitate gripping by a hand of the user, b. a head portion including bristle means attached thereto for brushing the teeth of the user, c. mounting means attached at least in part to said handle and structured for removable mounting of said head on said handle, d. said mounting means comprising a mounting rod fixedly secured to said handle and extending outwardly from one end thereof at an angular orientation to a longitudinal axis of said handle, e. said mounting means further including an elongated channel formed in said head portion at an angular orientation to a longitudinal axis of said head portion and being dimensioned and structured to removably receive said mounting rod therein, f. said mounting rod and said channel cooperatively and angularly oriented to dispose said head on said handle in a plurality of operative positions, g. anti-rotation means for preventing rotation of said head relative to said handle when disposed in one of said plurality of operative positions, said anti-rotation means including a multi-sided configuration formed about an outer surface of said mounting rod and being structured and configured for non-rotational engagement with a corresponding multi-sided configuration formed along an inner surface of said elongated channel, h. locking means for providing locking engagement of said head portion with said handle when in one of said plurality of operative positions, said locking means including a barbed extension formed on said mounting rod being structured and disposed for locking engagement with a receiving portion being structured to expand outwardly upon forced, locking engagement with said barbed extension, i. said plurality of operative positions comprising a first position defined by said head portion disposed in a substantially straightline orientation relative to said longitudinal axis of said handle and a plurality of different angular positions defined by varying angular orientations of said head portion relative to said longitudinal axis of said handle, j. said one end of said handle including a substantially semi-spherical configuration dimensioned and configured to be removably received within an indented socket formed in said head portion substantially about said elongated channel, and k. whereby said head may be adjustably mounted on said handle at a plurality of selected operative positions.

2. An assembly as in claim 1 wherein said mounting rod and said channel each include a cooperatively configured transverse cross-section along a portion of their respective lengths being disposed in confronting engagement, said cross-section configured to define a plurality of substantially angular orientations of said head relative to said handle.

3. An assembly as in claim 1 wherein one end of said mounting rod is fixedly embedded in said handle and is of sufficient length to extend outwardly from a free end thereof.

4. An assembly as in claim 3 wherein said channel comprises a receiving open end contiguous to one free end of said head and dimensioned to allow passage of said mounting rod therethrough into said channel.

5. An assembly as in claim 4 wherein said free end of said handle and said one free end of said head are cooperatively configured for confronting, mating engagement when said handle and head are in any of said plurality of operative positions.

6. An assembly as in claim 1 wherein said channel is of a sufficient length to receive at least a majority of the length of said mounting rod therein.

* * * * *